US008303914B2

(12) United States Patent
Zurcher

(10) Patent No.: US 8,303,914 B2
(45) Date of Patent: Nov. 6, 2012

(54) TUBE CLOSURE WITH REMOVABLE SEPTUM FOR DIRECT INSTRUMENT ACCESS

(75) Inventor: Robert G. Zurcher, Little Falls, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 1778 days.

(21) Appl. No.: 10/337,092

(22) Filed: Jan. 6, 2003

(65) Prior Publication Data

US 2004/0131506 A1 Jul. 8, 2004

(51) Int. Cl.
*B01L 3/14* (2006.01)

(52) U.S. Cl. ..... 422/550; 422/547; 422/548; 422/549

(58) Field of Classification Search ..... 422/99, 422/102, 547, 548, 549, 550; 215/247, 232, 215/320, 350, 354; 604/256, 415, 905
See application file for complete search history.

(56) References Cited

U.S. PATENT DOCUMENTS

| | | | | |
|---|---|---|---|---|
| 4,583,652 | A | 4/1986 | Goldberg | |
| 5,088,612 | A * | 2/1992 | Storar et al. | 215/247 |
| 5,779,074 | A | 7/1998 | Burns | |
| 5,788,101 | A * | 8/1998 | King | 215/349 |
| 5,972,297 | A * | 10/1999 | Niermann et al. | 422/102 |
| 6,030,582 | A * | 2/2000 | Levy | 422/99 |
| 6,280,400 | B1 * | 8/2001 | Niermann | 600/573 |
| 6,375,022 | B1 * | 4/2002 | Zurcher et al. | 215/247 |
| 6,622,882 | B2 * | 9/2003 | Smith | 220/259.1 |
| 2002/0079284 | A1 | 6/2002 | Carano | |

FOREIGN PATENT DOCUMENTS

| | | | |
|---|---|---|---|
| EP | 0 569 835 | A1 | 11/1993 |
| WO | WO 02/072265 | A1 | 9/2002 |

* cited by examiner

*Primary Examiner* — Jill Warden
*Assistant Examiner* — Dwayne K Handy
(74) *Attorney, Agent, or Firm* — The Webb Law Firm

(57) ABSTRACT

A closure assembly is provided for a specimen collection container. The closure assembly includes a bottom ring and top ring assembly. The bottom ring is removably attachable to the open end of the container. The top ring assembly, which is removably attached to the bottom ring, includes a mounting ring and a pierceable, resealable septum that closes the bottom ring and permits pierceable instrument access therethrough. The container interior can also be accessed by the removal of the bottom ring from the open end of the container or by the removal of the top assembly from the bottom ring.

32 Claims, 5 Drawing Sheets

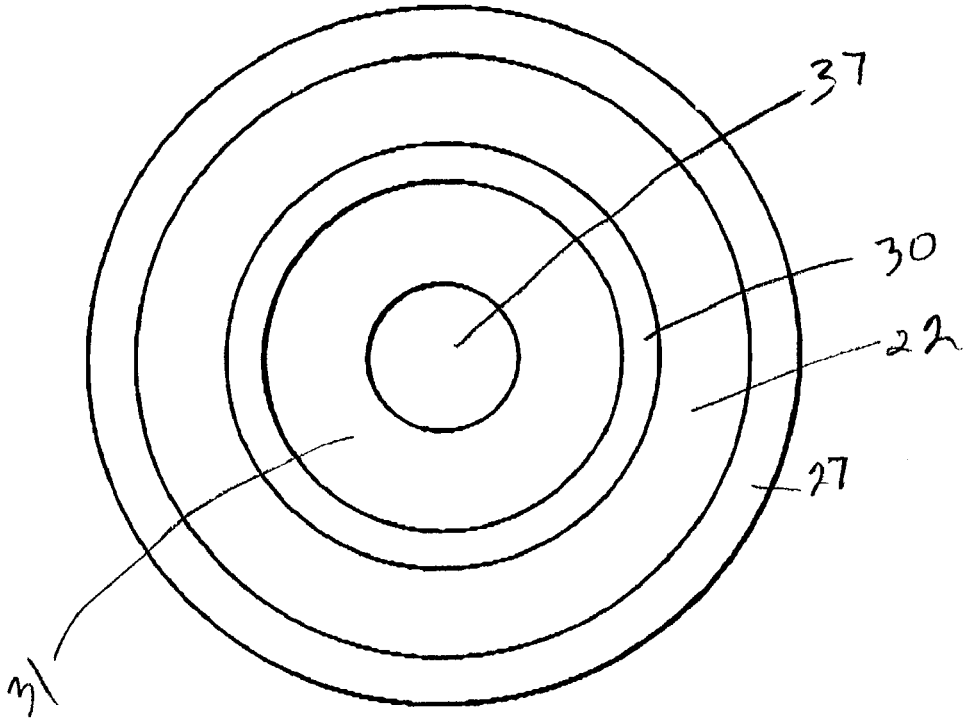
FIG.3
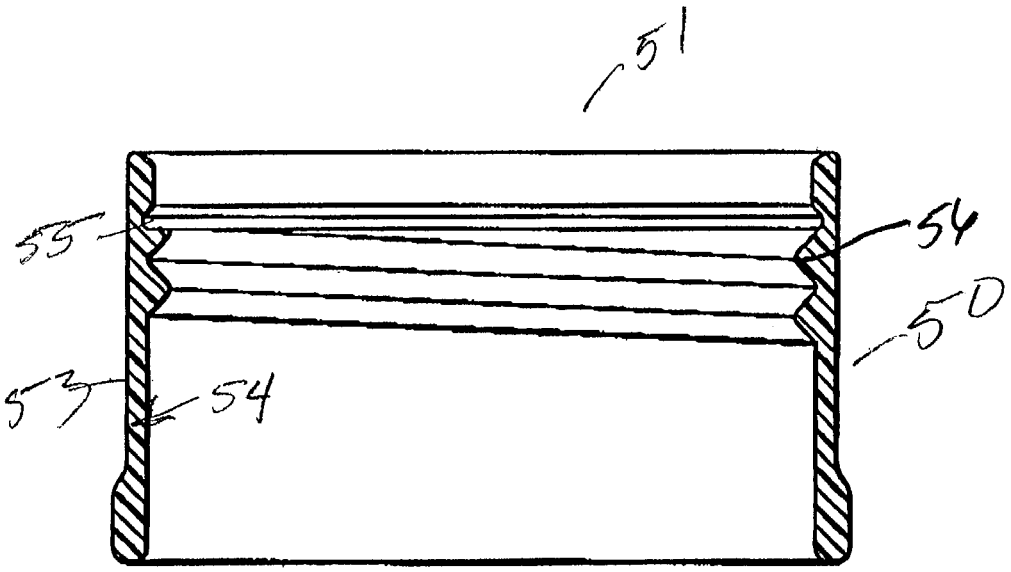
52 FIG.4

TUBE CLOSURE WITH REMOVABLE SEPTUM FOR DIRECT INSTRUMENT ACCESS

BACKGROUND OF THE INVENTION

1. Field of the Invention

The present invention relates to a two piece closure assembly for containers that allows for sample purity while enabling direct access to a sample by diagnostic instrument probes.

2. Description of Relevant Art

Tubes, containers and other collection devices include an open top having a closure that can be removed or opened to access the interior of the container.

Some closures comprise an elastomeric stopper that can be urged into the open top of the container to provide a liquid-tight seal. The stopper can be removed to access the interior of the container and then can be replaced in the opening to reseal the container. The stopper provides a liquid tight seal both before the initial opening of the container and during any reclosure of the container. However, stoppers do not provide a hermetic seal which is necessary in some instances to ensure sterility.

Other closures include structure for threaded or snap fit engagement with the top of the container. These closures are convenient for periodically accessing the contents of the container, but also do not provide a hermetic seal.

Some containers have a barrier bonded or hermetically sealed over the open top of the container. The barrier is substantially impermeable to most gases and liquids, and hence, the contents of the container can be hermetically sealed prior to use. However, these barriers cannot reseal the open top of the container after the initial opening. Thus, an entirely separate closure is required to re-close the container after the initial use.

Additionally, there is a need in the art for closures which may be able to both maintain the purity of a sample and also easily enable direct access to a sample by diagnostic probes.

SUMMARY OF THE INVENTION

The invention provides a closure assembly for a specimen collection container having an open end and opposed closed end and a side wall therebetween, defining a container interior. The closure assembly includes a bottom ring removably attachable to the open end of the container and a top ring assembly removably attachable to the bottom ring for closing the open end of the container. The top ring assembly further includes a mounting ring removably attachable to the bottom ring, the mounting ring having an opening therein for communication with the container interior. A pierceable, resealable septum closing the opening and permitting pierceable instrument access therethrough is also included. Furthermore, the container interior is accessible through the open end by removing the bottom ring from the open end and by the removal of the mounting ring from the bottom ring.

More particularly, the closure assembly is screw attachable to the open end of the container so as to provide replaceable removal therefrom. The top ring assembly is attached to the bottom ring by a snap fit which allows access to the container through the bottom ring.

Thus, the container is accessible by unscrewing the cover assembly or by removal of the top ring assembly of the bottom ring.

Furthermore, the present invention provides a kit of parts adapted for closing a specimen collection container having an open end, a closed end, and a cylindrical side wall defining a container interior. The kit of parts includes a bottom ring removably attachable to the open end of the container and a top ring assembly. The top ring assembly is adapted for removable attachment of the bottom ring for closing the open end. The top ring assembly includes a mounting ring removably attachable to the bottom ring and a pierceable septum for permitting instrument access to the container interior therethrough. The kit also includes a replacement ring adapted for removable attachment to the bottom ring for closing the open end.

BRIEF DESCRIPTION OF THE FIGURES

FIG. 3 is a top plan view of the top ring assembly shown in FIG. 2.

FIG. 4 is a longitudinal cross-sectional view of the bottom ring of the closure assembly of FIG. 1.

DETAILED DESCRIPTION

Figure 1:
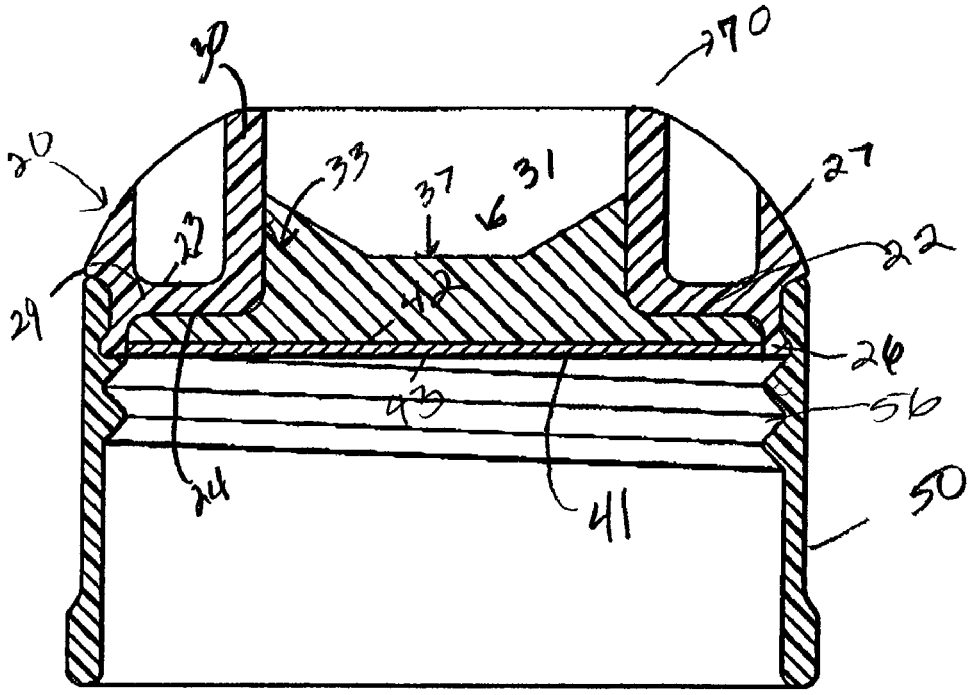
FIG. 1 is a longitudinal cross-sectional view of the closure assembly of the invention.
Figure 8:
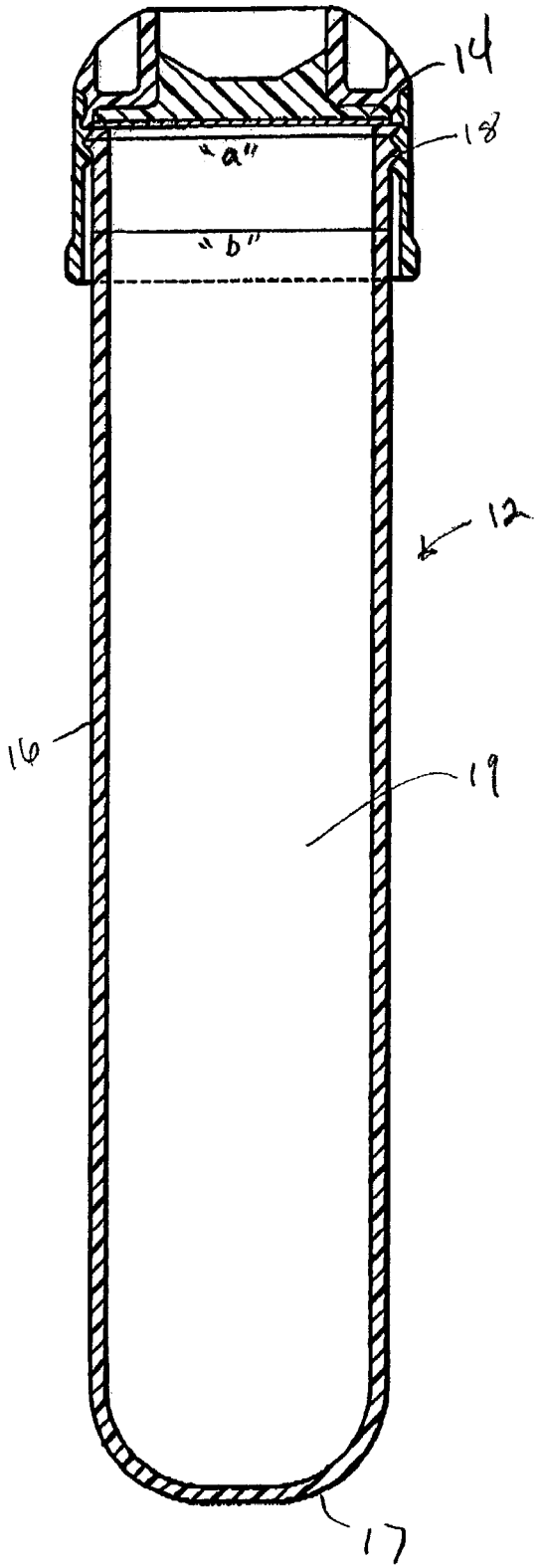
FIG. 8 is a longitudinal cross-sectional view of a container.

Referring to the drawings in which the like reference characters refer to like parts throughout the several views thereof, FIG. 1 illustrates closure assembly 70 that is used for hermetically sealing and subsequently resealing a container 12 (FIG. 8).

Figure 7:
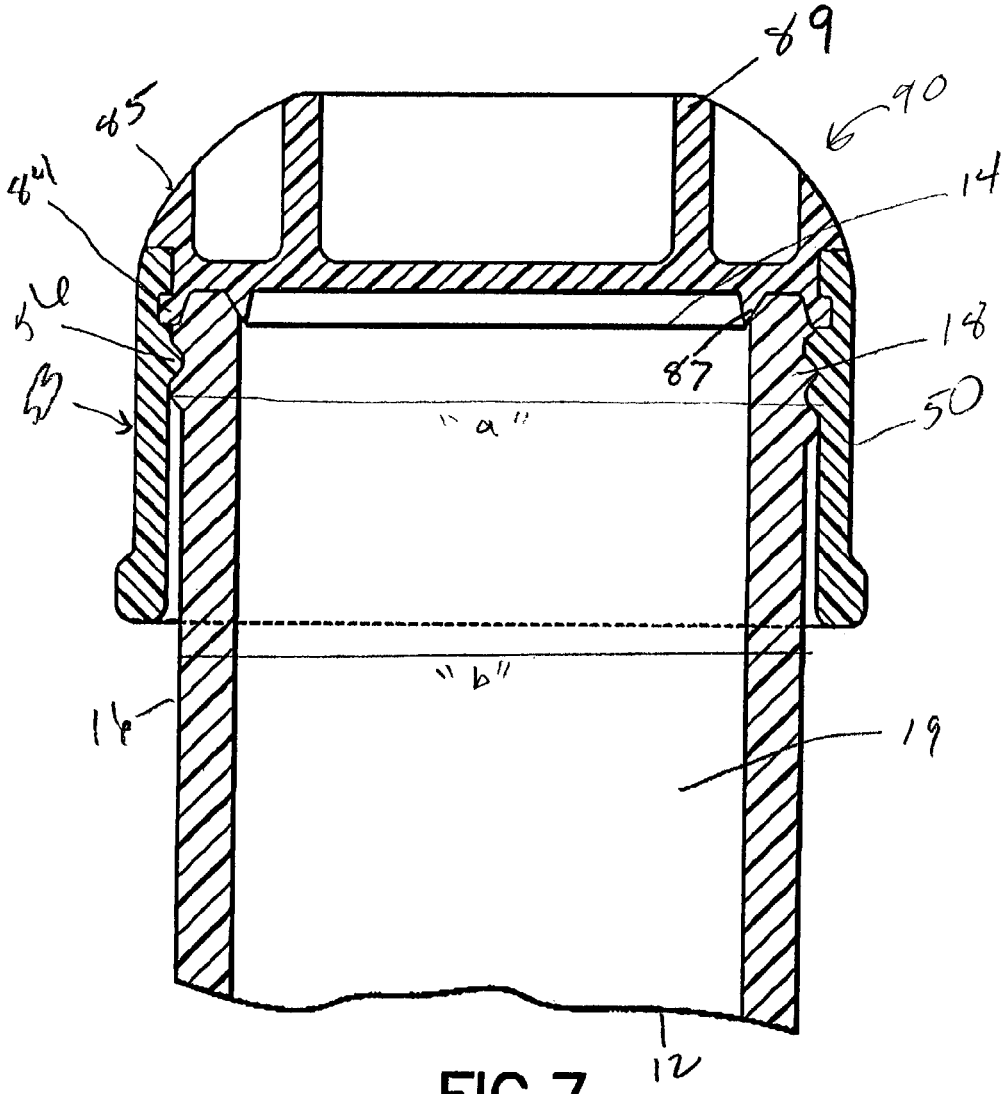
FIG. 7 is a longitudinal cross-sectional view of the container and closure assembly with the replacement top ring of FIG. 6.

Container 12 as shown in FIGS. 7 and 8, includes a closed bottom 17, an open top at the opposite end 14 of the closed bottom 17, and a cylindrical side wall 16 extending therebetween defining an interior 19. Located on the outer surface of side wall 16 in proximity to open top 14 are external screw threads for engagement with closure assembly 70.

Figure 2:
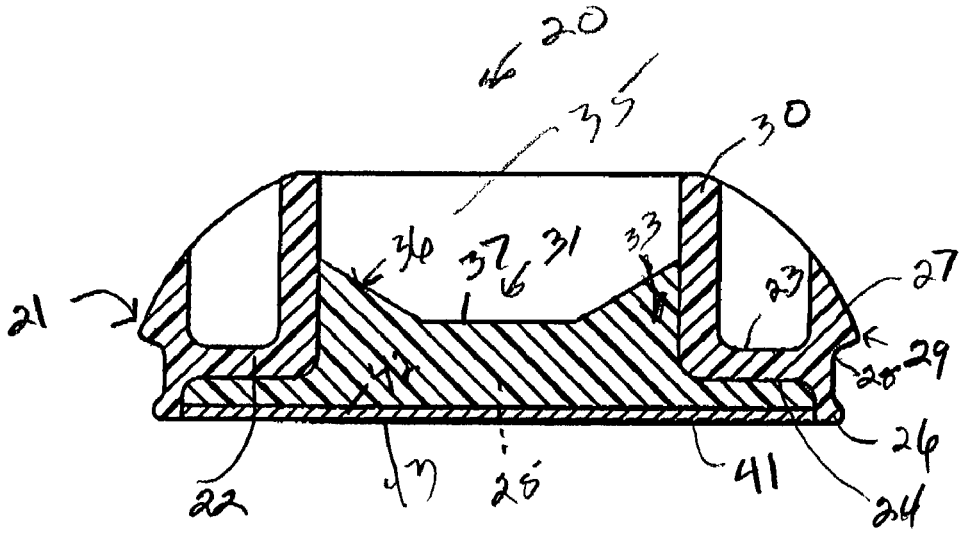
FIG. 2 is a longitudinal cross-sectional view of the top ring assembly of the closure assembly of FIG. 1.
Figure 5:
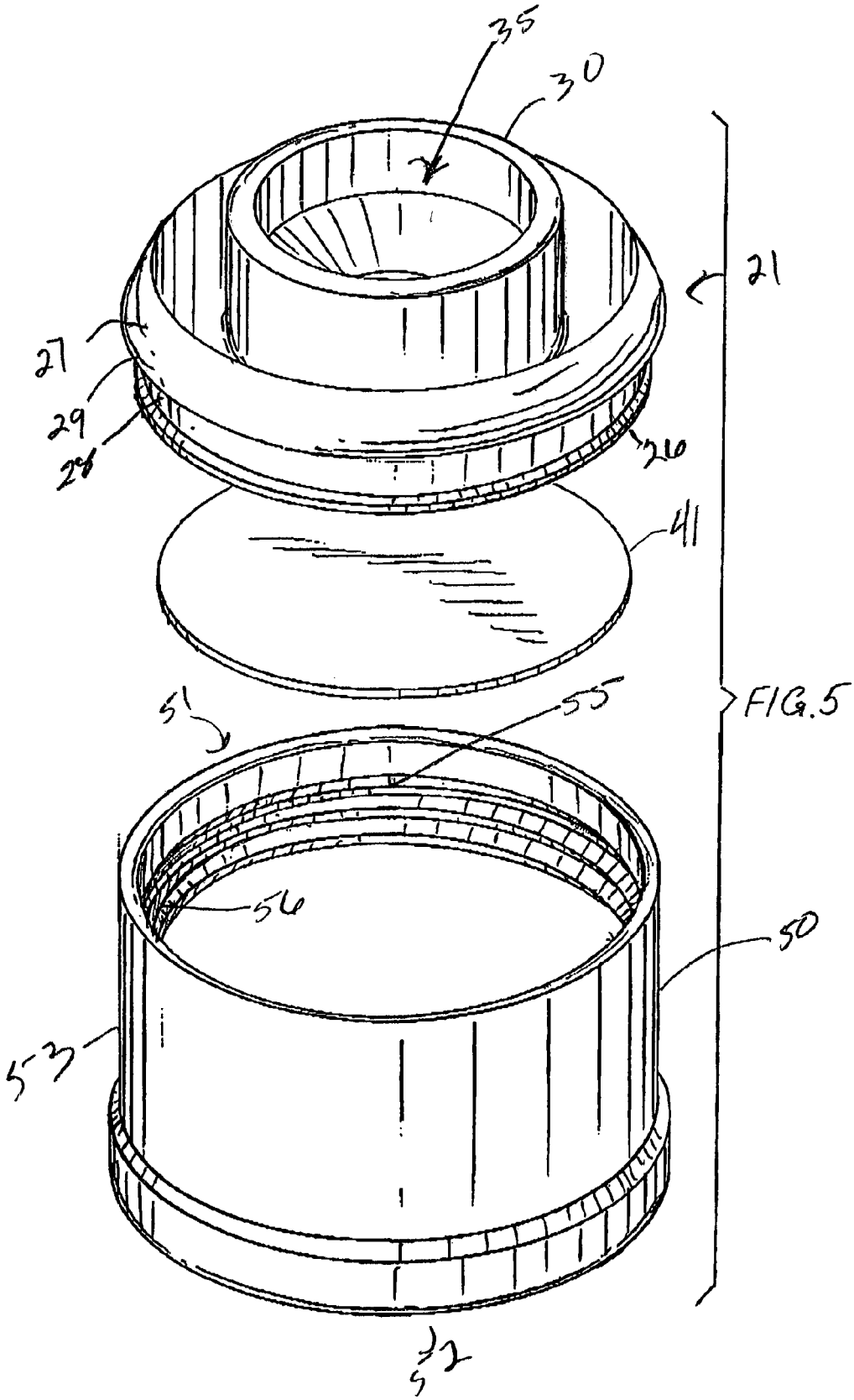
FIG. 5 is an exploded perspective view of the closure assembly of the invention.

Closure assembly 70 includes a top ring assembly 20 and bottom ring 50 as shown in FIGS. 1 and 5. As more fully shown in FIGS. 2 and 3, the top ring assembly 20 is fabricated from three parts: a molded plastic mounting ring 21, a septum 31 and a barrier 41.

The molded plastic mounting ring 21 is generally an annular member including an annular bottom wall 22 having opposed surfaces 23 and 24. Ring 21 defines a central opening 25 therethrough. Depending downwardly from the periphery of bottom surface 24 is an outwardly directed annular snap rib 26. Extending upwardly from the outer perimeter of the bottom wall 22 is an annular shoulder 27. An inwardly directed notch 28 is formed between the snap rib 26 and a protrusion 29 along the annular shoulder 27. A centrally located annular boss 30 extends upwardly from the bottom wall 24 and inwardly of the annular shoulder 27 to define an open cylindrical region 35.

Top assembly 20 further includes a disc-like septum, 31. Septum 31 is unitarily molded from a thermoplastic elastomer or thermoset resin and defines an outer diameter which is approximately equal to inner diameter of annular snap rib 26. This allows the septum 31 to be force fitted into the mounting ring 21 adjacent surfaces 24 of wall 22 to close the opening 25. Septum 31 includes a central raised portion 33 which extends into the cylindrical region 35. The upper surface 36 of raised portion 33 is tapered inwardly toward a flat center 37. Septum 31 is capable of being pierced by a needle cannula or other probe instrument (not shown) to access or deposit material into container 12. The cannula is directed toward the flat center 37 by the inward taper of the septum 31. Upon withdrawal of a needle cannula, septum 31 will reseal the puncture site.

Top assembly 20 further includes a barrier layer 41 having a top face 42 and a bottom face 43. Barrier layer 41 is unitarily formed from a liquid and gas impermeable material that will provide a vapor barrier. For example, barrier layer 41 may be formed from a metallic foil, such as aluminum foil, or from a metallic foil laminated on one or both sides with a plastic material. Alternatively, barrier layer 41 may be formed from a metalized polyester, a ceramic coated polyester, polyester-olefin, PVDC or other material that provides a vapor barrier. The barrier layer 41 is coated on both faces 42 and 43 with an adhesive to provide structural integrity with the septum 31 and container 12.

Closure assembly 70 also includes bottom ring 50 as seen in FIGS. 1, 4, 5, 7 and 8. The bottom ring 50 is generally an annular member having a top end 51 and a bottom end 52. A cylindrical side wall, 53, extends therebetween. The inner surface 54 of the side wall 53, proximal to the top end 51 has an internal retaining groove 55 that is engageable with the outwardly extending snap rib 26 of mounting ring 21 of top assembly 20. The cooperative structure of the retaining groove 55 of ring 50 and the snap rib 26 of mounting ring 21 allows for removable snap fit engagement between the top ring 21 and the bottom ring 50. Below and proximal to the retaining groove 55 of the inner wall surface 54 are internal screw threads 56 that are engageable with external threads, 18, on container 12 for removable screw attachment at ring 50.

The top ring assembly 20 is snapped into the bottom ring 50 to complete the closure assembly 70. The top end 51 of the side wall 54 of the bottom ring 50 engages with the annular shoulder 27 of the top ring assembly 20. The snap rib 26 becomes seated within retaining groove 55 in a secure but removable fashion. On assembly, the closure assembly 70 is threadably engaged with the container 12. This engagement may be accomplished on a device assembly line. After the closure assembly 70 is engaged to the container 12, container 12 is passed through an induction field to heat and fuse the barrier 41 to container 12, resulting in an effective seal against the entry of oxygen.

The closure assembly 70 can be removed by manually twisting the entire closure assembly 70. Alternatively, laboratory uncapping machines may be used to automatically uncap the top ring assembly 20 of the closure assembly 70. Removing only the top ring assembly 20 enables the interior 19 of the container 12 to direct access by laboratory instruments.

The container 12 is resealable. If the closure assembly 70 has been manually removed by unscrewing, it may be screwed back onto the container 12 Alternatively, if the top assembly 20 has been automatically removed by a laboratory uncapping machine, a replacement top ring 80 can be used to reseal the closure.

Figure 6:
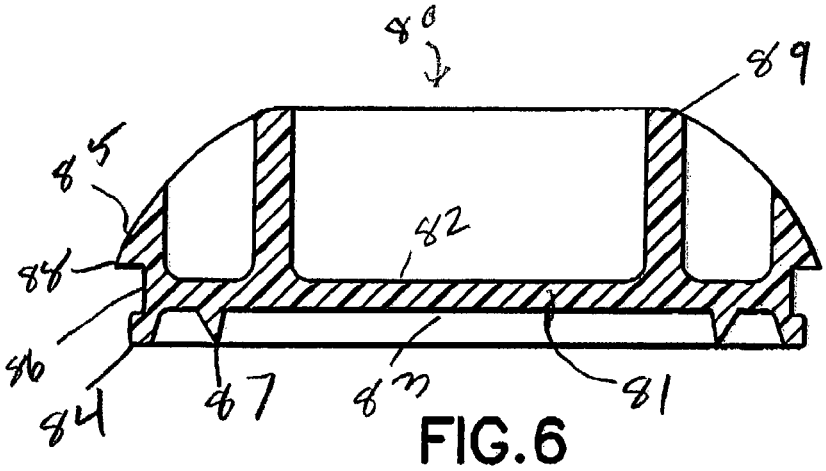
FIG. 6 is a longitudinal cross-sectional view of a replacement top ring.

Replacement top ring 80 is shown in FIGS. 6 and 7. The replacement top ring 80 is fabricated from molded plastic and includes a bottom wall 81 with opposed surfaces 82 and 83. Depending downwardly from the bottom wall 81 is a perimetrically extending annular snap rib 84. Extending upwardly from the outer perimeter of the bottom wall 81 is an annular shoulder 85. An inwardly directed notch 86 is formed between snap rib 84 and protrusion 88 of the annular shoulder 85. Internal to the snap rib 84 is a plug seal ring 87 for annular engagement with container 12 at an internal location. A centrally located annular boss 89 extends upwardly from the bottom wall 81, inwardly from the annular shoulder 85 and internal to the plug seal ring 87.

Replacement top ring 80 is snapped into bottom ring 50 to complete replacement closure assembly 90 (FIG. 7). The top end 51 of the side wall 54 of the bottom ring 50 engages with the annular shoulder 85 of the replacement top ring assembly 80. The snap rib 84 becomes seated within retaining groove 55 in a secure but removable fashion. Plug seal ring 87 is disposed on the inner surface of side wall 16 of container 12 proximal to the open top 14. On assembly, replacement closure assembly 90 is threadably engaged with the container 12.

If it becomes necessary to access the contents of the container 12 again, the replacement top ring 80 can be removed by a laboratory uncapping machine or the replacement closure assembly 90 can be unscrewed from the container 12.

Various other changes and modifications may be effected therein by one skilled in the art without departing from the scope or spirit of the invention, and it is intended to claim all such changes and modifications as fall within the scope of the invention.

What is claimed is:

1. A closure assembly for a specimen collection container having an open end, an opposed closed end, and a side wall therebetween, defining a container interior, said closure assembly comprising:

a bottom ring removably attachable to said open end of said container; and a top ring assembly removably attachable to said bottom ring when said bottom ring is attached to said container for closing said open end of said container, said top ring assembly including:

a mounting ring removably attachable to said bottom ring, said mounting ring having an opening therein for communication with said container interior, said mounting ring comprising an annular projection extending around an outer circumference of the mounting ring adapted to engage a cooperative structure in said bottom ring in a snap fit arrangement so as to secure said mounting ring to said bottom ring in a fixed coaxial relationship; and a pierceable, resealable septum closing said opening and permitting pierceable instrument access therethrough.

2. The closure assembly of claim 1, wherein said container interior is further accessible through said open end by said removal of said bottom ring from said open end and by said removal of said mounting ring from said bottom ring.

3. The closure assembly of claim 1, wherein said top ring assembly further comprises a barrier having a top face and a bottom face, said top face of said barrier supported adjacent said septum.

4. The closure assembly of claim 3, wherein said barrier is adhesively supported to said septum.

5. The closure assembly of claim 3, wherein said barrier further includes a foil layer.

6. The closure assembly of claim 1, wherein said bottom ring is internally screw threaded for removable screw attachment with the open end of said container.

7. The closure assembly of claim 1, wherein said septum is formed of a thermoplastic elastomer.

8. The closure assembly of claim 1, wherein said septum is supported within said mounting ring opening by a force-fit.

9. The closure assembly of claim 1, wherein said mounting ring further comprises an annular shoulder.

10. The closure assembly of claim 9, wherein said annular shoulder is adapted to engage a top of a sidewall of said bottom ring.

11. The closure assembly of claim 1, wherein said mounting ring is removably secured to said bottom ring.

12. A resealable specimen collection container comprising:

a container body having an open end, a closed end, and a cylindrical side wall therebetween defining a container interior;

a closure assembly for closing said open end of said container body, said closure assembly including:

a bottom ring removably attachable to said open end of said container; and a top ring assembly removably attachable to said bottom ring for closing said open end of said container, said top ring assembly further including:

a mounting ring removably attachable to said bottom ring when said bottom ring is attached to said container, said mounting ring having an opening therein for communication with said container interior, said mounting ring comprising an annular projection extending around an outer circumference of the mounting ring adapted to engage a cooperative structure in said bottom ring in a snap fit arrangement so as to secure said mounting ring to said bottom ring in a fixed coaxial relationship; and a pierceable, resealable septum closing said opening and permitting pierceable instrument access therethrough.

13. The resealable specimen collection container of claim 12, wherein said container interior is further accessible through said open end by said removal of said bottom ring from said open end and by said removal of said mounting ring from said bottom ring.

14. The resealable specimen collection container of claim 12, wherein said top ring assembly further comprises a barrier having a top face and a bottom face, said top face of said barrier supported adjacent said septum.

15. The resealable specimen collection container of claim 14, wherein said barrier is adhesively supported to said septum.

16. The resealable specimen collection container of claim 14, wherein said barrier further includes a foil layer.

17. The resealable specimen collection container of claim 12, wherein said bottom ring is internally screw threaded for removable screw attachment with the open end of said container.

18. The resealable specimen collection container of claim 12, wherein said septum is formed of a thermoplastic elastomer.

19. The resealable specimen collection container of claim 12, wherein said septum is supported within said mounting ring opening by a force-fit.

20. The resealable specimen collection container of claim 12, wherein said mounting ring further comprises an annular shoulder.

21. The resealable specimen collection container of claim 20, wherein said annular shoulder is adapted to engage a top of a sidewall of said bottom ring.

22. The resealable specimen collection container of claim 12, wherein said mounting ring is removably secured to said bottom ring.

23. A kit of parts adapted for closing a specimen collection container having an open end, a closed end, and a cylindrical side wall defining a container interior, said kit of parts comprising:

a bottom ring removably attachable to said open end of said container;

a top ring assembly adapted for removable attachment to said bottom ring when said bottom ring is attached to said container for closing said container open end, said top ring assembly including:

a mounting ring removably attachable to said bottom ring, said mounting ring comprising an annular projection extending around an outer circumference of the mounting ring adapted to engage a cooperative structure in said bottom ring in a snap fit arrangement so as to secure said mounting ring to said bottom ring in a fixed coaxial relationship;

a pierceable septum for permitting instrument access to said container interior therethrough; and a replacement ring adapted for removable attachment to said bottom ring for closing said open end of said container.

24. The kit of parts of claim 23, wherein said top ring assembly further comprises a barrier having a top face and a bottom face, said top face of said barrier supported adjacent said septum.

25. The kit of parts of claim 24, wherein said barrier is adhesively supported to said septum.

26. The kit of parts of claim 25, wherein said barrier further includes a foil layer.

27. The kit of parts of claim 23, wherein said bottom ring is internally screw threaded for removable screw attachment with the open end of said container.

28. The kit of parts of claim 23, wherein said septum is formed of a thermoplastic elastomer.

29. The kit of parts of claim 23, wherein said septum is supported within said mounting ring opening by a force-fit.

30. The kit of parts of claim 23, wherein said bottom ring and said replacement top ring include cooperative structure for removable snap fit engagement therebetween.

31. The kit of parts of claim 23, wherein said mounting ring further comprises an annular shoulder.

32. The kit of parts of claim 31, wherein said annular shoulder is adapted to engage a top of a sidewall of said bottom ring.

* * * * *